US006550586B1

(12) United States Patent
Takeuchi

(10) Patent No.: US 6,550,586 B1
(45) Date of Patent: Apr. 22, 2003

(54) DISPLAY OPERATING DEVICE FOR ELEVATOR

(75) Inventor: Nobukazu Takeuchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/069,055

(22) PCT Filed: Jun. 23, 2000

(86) PCT No.: PCT/JP00/04153

§ 371 (c)(1),
(2), (4) Date: Feb. 21, 2002

(87) PCT Pub. No.: WO01/98192

PCT Pub. Date: Dec. 27, 2001

(51) Int. Cl.[7] ..... B66B 3/00; B66B 1/34
(52) U.S. Cl. ..... 187/391; 187/396
(58) Field of Search ..... 187/247, 391, 187/392, 394, 396, 380–382, 414; 345/156, 173–176, 178; 340/815.4, 815.48, 3.43, 3.44

(56) References Cited

U.S. PATENT DOCUMENTS 4,716,992 A * 1/1988 Kunii ..... 187/395
5,679,934 A 10/1997 Juntunen et al.
6,161,654 A 12/2000 Sirigu et al.
6,315,083 B1 * 11/2001 Schuster et al. ..... 187/391
6,326,934 B1 * 12/2001 Kinzie ..... 345/1.1
6,341,668 B1 * 1/2002 Fayette et al. ..... 187/391
6,502,668 B1 * 1/2003 Chida et al. ..... 187/395
6,508,334 B1 * 1/2003 Matsuda et al. ..... 187/391

FOREIGN PATENT DOCUMENTS

GB 2241090 A * 8/1991 ..... B66B/01/20
JP 6-144726 5/1994
JP 06144726 A * 5/1994 ..... B66B/01/50
JP 8-208157 8/1996
JP 2000-26033 1/2000
JP 2001233556 A * 8/2001 ..... B66B/03/00
JP 2001302128 A * 10/2001 ..... B66B/03/02

* cited by examiner

*Primary Examiner*—Jonathan Salata
(74) *Attorney, Agent, or Firm*—Leydig, Voit & Mayer, Ltd.

(57) ABSTRACT

A display/operation apparatus for an elevator system includes an intra-car operation panel or a hall-oriented operation panel or the like which includes an image display device and a touch screen display in which a touch switch array overlaps a displayed image of the image display device. In a normal operation state, functions of operation buttons displayed on the image display device or the like are validated. In the apparatus, a specific operation button array allows a predetermined input operation to be performed upon occurrence of a fault, at least in the touch screen display.

14 Claims, 8 Drawing Sheets

DISPLAY OPERATING DEVICE FOR ELEVATOR

TECHNICAL FIELD

The present invention relates to a display/operation apparatus for an elevator system and more particularly to the display/operation apparatus which is equipped with a touch screen display or the like.

BACKGROUND TECHNIQUES

As the conventional display/operation apparatuses for the elevator system known heretofore, there can be mentioned those equipped with a so-called push-button-type switch array which includes car call buttons or destination indicating buttons physically pushed through operation by a passenger of the elevator or a touch button switch array operated by touching concave or like portions of the buttons and additionally equipped with lamps which are caused to light in response to operation of buttons dedicated for registration of calls entered by the passenger and/or an indicator realized in the form of a seven-segment display device or the like for indicating the position of the elevator car by numerical symbols, wherein the display/operation apparatus is installed internally of the elevator car and/or at an elevator hall.

Recently, there has been proposed such type of the display/operation apparatus in which an image display is used as a display device with an array of touch switches making appearance on the image displaying surface so as to function as a touch screen display, as is disclosed in Japanese Patent Application Laid-Open Publication No. 144726/1994 or U.S. Pat. No. 5,679,934 (corresponding to Japanese Patent Application Laid-Open Publication No. 208157/1996).

Additionally, such type of display/operation apparatus has also been proposed in which contents of the graphic information to be displayed are projected as an image or images onto a region of a wall surface in which touch pads are provided in advance so that desired operation or operation can be effectuated discriminatively by touching a relevant pad or pads, as is disclosed in Japanese Patent Application Laid-Open Publication No. 026033/2000.

However, differing from the conventional display/operation apparatus composed of push buttons and lamps, the touch screen display for displaying graphic images or pictures as well as the projection-type display/operation apparatus developed recently suffers a problem that occurrence of some abnormality in some portion of the display device will result in shutdown of the whole display function and hence the passengers are utterly at a loss as to how to perform an input operation because no input means are displayed, incurring thus remarkable degradation of the reliability of the elevator system.

Further, with regard to the input operation through operation of the touch screen display, it is observed that upon occurrence of an abnormality in the function of a control module for the touch switches on the touch screen display, the input operation on the whole is rendered invalid, while in the case of the projection-type touch pad position display, the very objects to be manipulated can no more be visibly recognized, incurring a panic among the passengers riding in the elevator car or confinement of the passengers within the car.

DISCLOSURE OF THE INVENTION

The present invention which has been made with a view to solving the problems such as described above contemplates it as an object to provide a display/operation apparatus in which specific operation buttons are provided independent of a touch screen display so that at least the most basic operation can be assured with the aid of the specific operation buttons even when a fault occurs in the touch screen display, to thereby prevent the elevator system from completely shutting down while ensuring safety and quietude for the passengers.

BEST MODES FOR CARRYING OUT THE INVENTION

In the following, description will be made in detail of the modes for carrying out the present invention by reference to the accompanying drawings.

Embodiment 1

Figure 1:
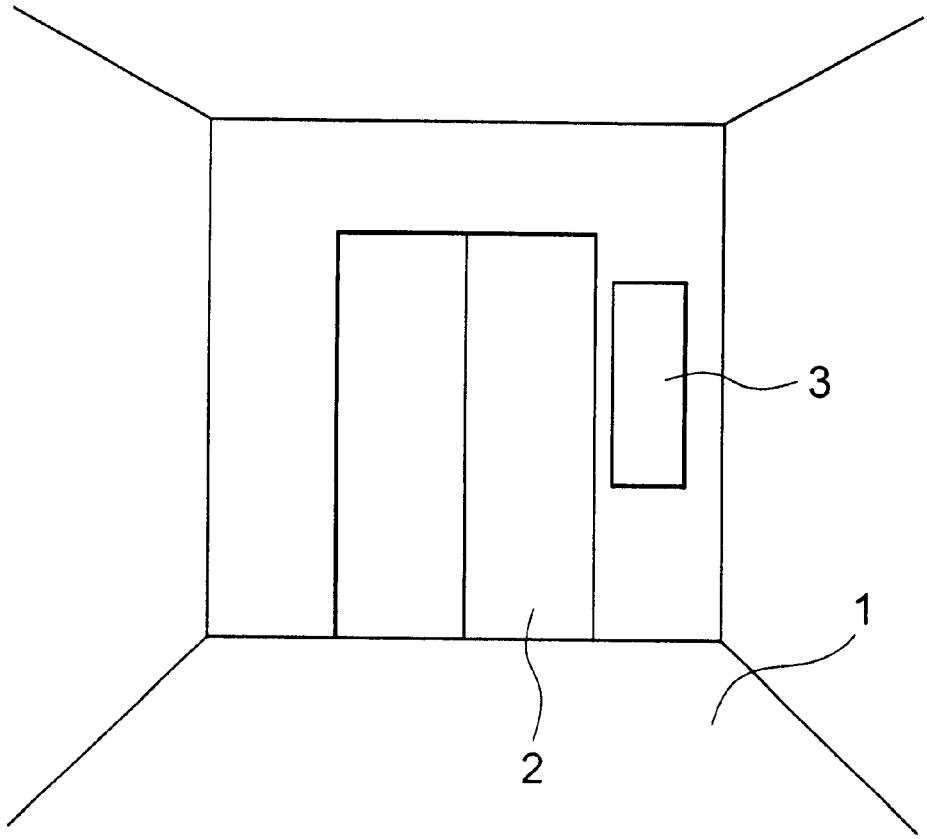
FIG. 1 is a perspective view showing a car chamber of an elevator system according to the present invention.
Figure 2:
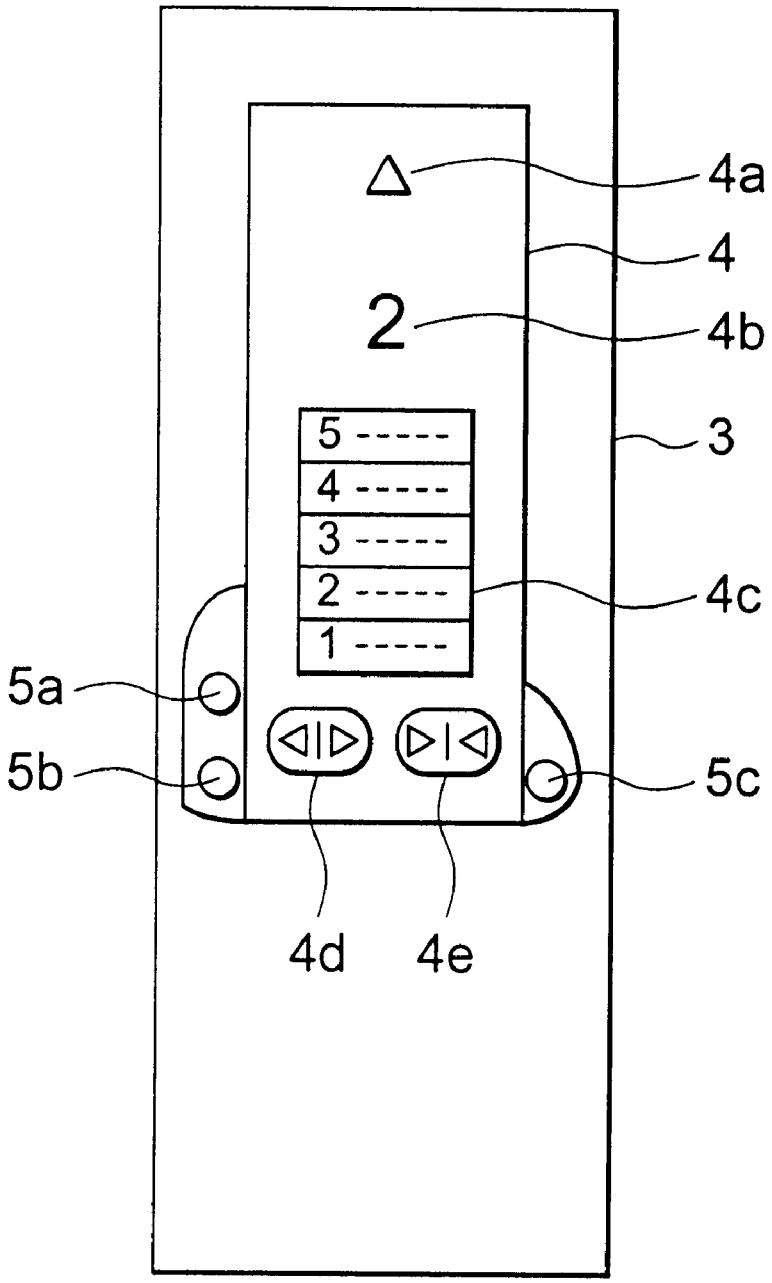
FIG. 2 is a front view of a operation panel according to the present invention.
Figure 3:
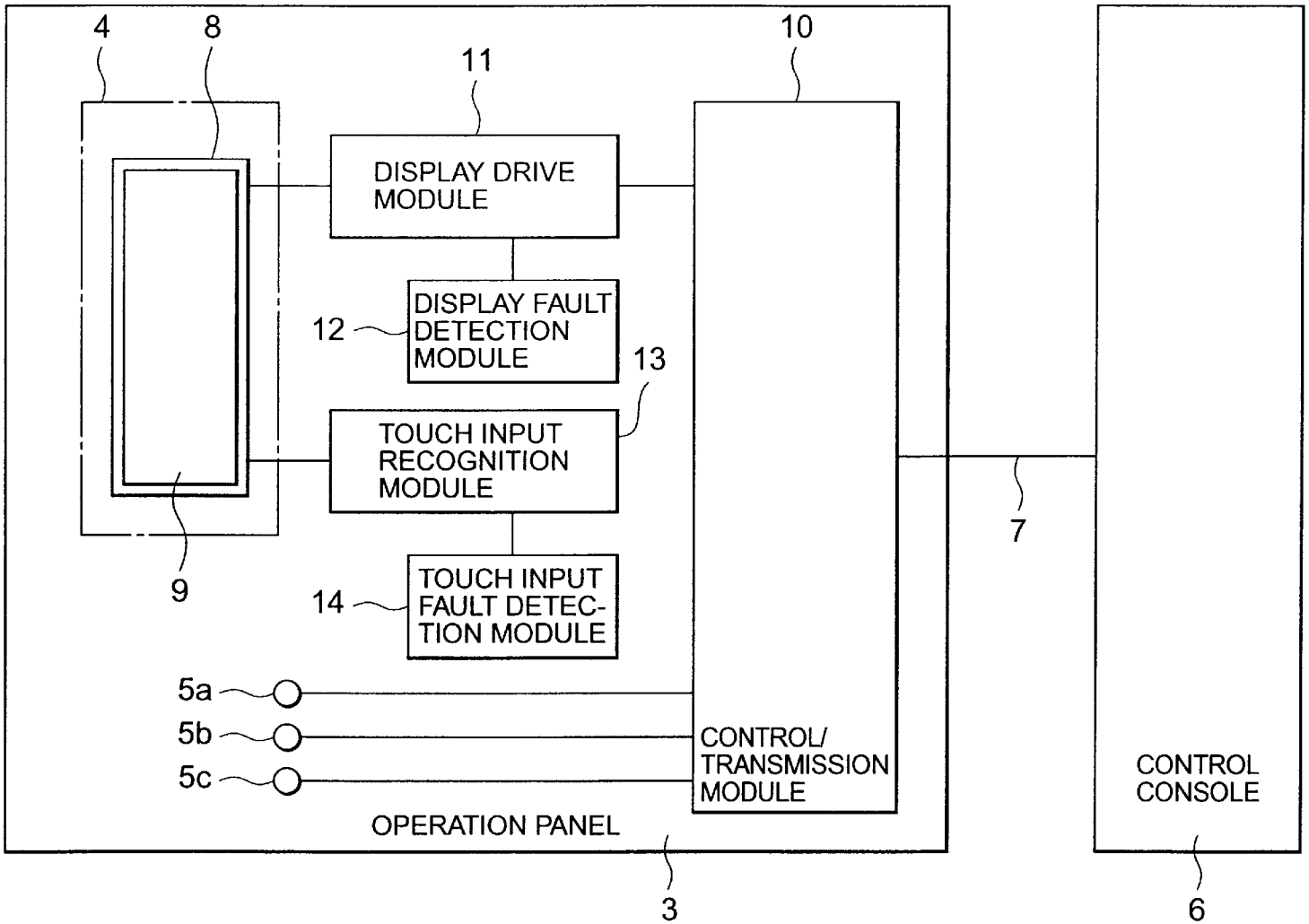
FIG. 3 is a block diagram showing a structural arrangement of a display/operation apparatus according to the present invention.
Figure 4:
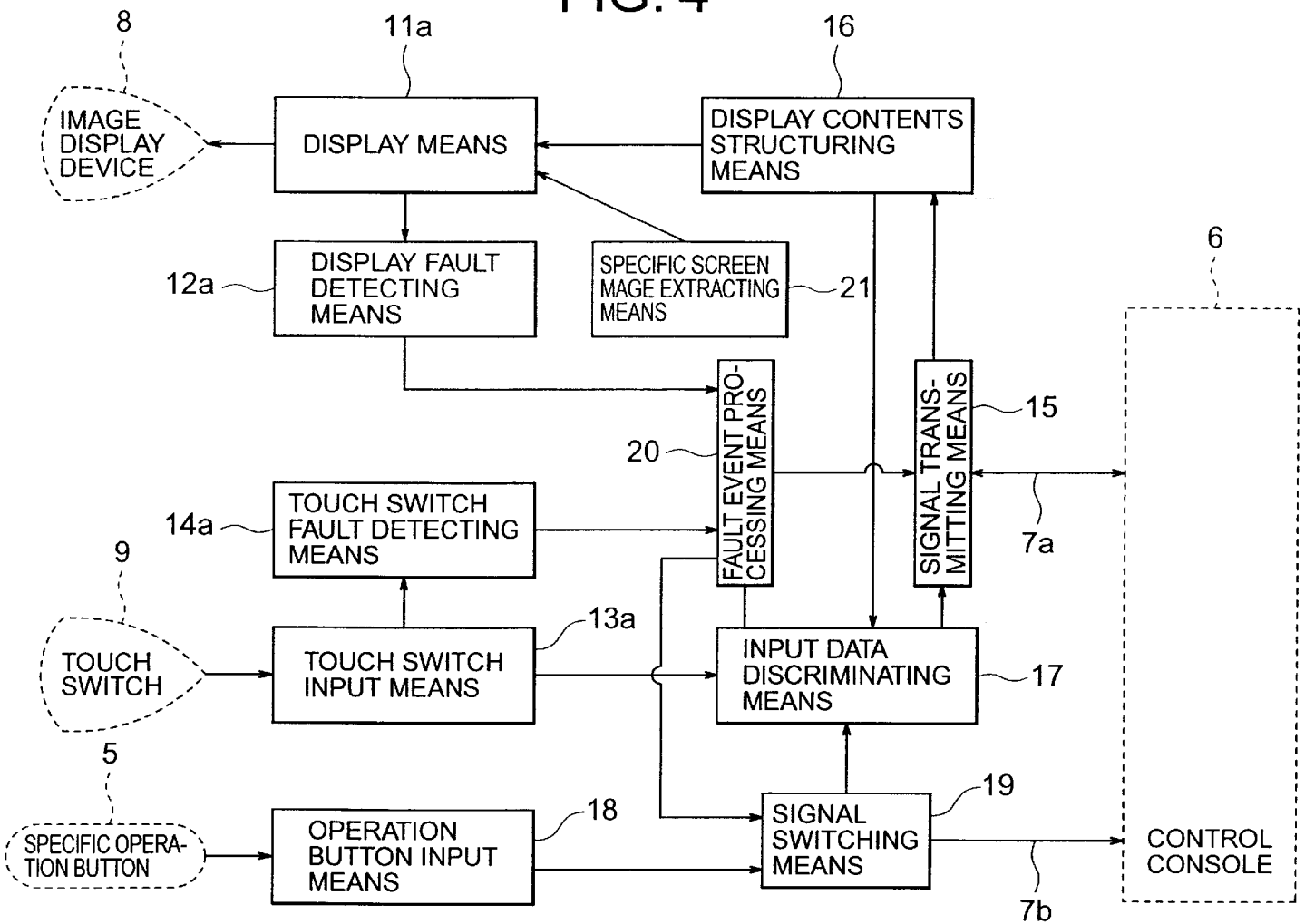
FIG. 4 is a functional block diagram showing a functional arrangement of the display/operation apparatus according to the present invention.

FIG. 1 is a perspective view showing an elevator car chamber in which a display/operation apparatus according to the present invention is installed, FIG. 2 is a front view of a operation panel which allows a passenger to manipulate a display device of the display/operation apparatus, FIG. 3 is a block diagram showing a structural arrangement of the display/operation apparatus mentioned above, and FIG. 4 is a functional block diagram of the above-mentioned display/operation apparatus. In the figures, reference numeral 1 denotes generally a car chamber of an elevator system, 2 denotes a car door, and numeral 3 denotes a operation panel of the display/operation apparatus. Further, reference numeral 4 denotes a touch screen display, 5 denotes generally a specific operation button array which includes three buttons 5*a*, 5*b* and 5*c* in the case of the instant embodiment of the invention. As items to be displayed in the touch screen display 4, there are illustrated a direction indicating lamp 4*a* indicating a traveling direction of the elevator car, a position indicator 4*b* indicating the position of the elevator car, a destination information/registration button array 4*c* indicating the information concerning the destination floor(s) and including buttons for registration of the destination floors, a door opening button 4*d* for opening the car door and a door closing button 4*e* for closing the door.

Reference numeral 6 denotes a control console for performing management/control of the elevator system, 7 denotes a signal cable or line for effecting signal transmission or transfer between the operation panel 3 and the control console 6, numeral 8 denotes an image display device for displaying images on the touch screen display 4, numeral 9 denotes a touch switch array for enabling touch input in response to operation of the touch screen display 4 by the user, and numeral 10 denotes a control/transmission module of the operation panel. Further, reference numeral 11 denotes a display drive module for causing the image display device 8 to display an image in response to a command of the control/transmission module 10, and reference numeral 12 is a display fault detection module for detecting a fault occurring in the display drive module 11. Additionally, reference numeral 13 denotes a touch input recognition module which is designed to respond to a touch signal containing information concerning the manipulated position as inputted through the touch switch 9 upon operation thereof for thereby recognizing the touch input as a operation signal, and numeral 14 denotes a touch input fault detection module for detecting a fault of the touch input recognition module 13.

Furthermore, reference numeral 15 denotes a signal transmitting means for performing reception/transmission of signals with the control console 6 by way of the signal cable or line 7, numeral 16 denotes a display contents structuring means for structuring and generating the display contents to be displayed as an image or images on the basis of command information sent from the control console 6 by way of the signal transmitting means 15, numeral 17 denotes an input data discriminating means for discriminatively identifying the function indicated by the signal data inputted through the touch input operation as recognized by the touch input recognition module 13, and numeral 18 denotes a operation button input means which responds to operation or operation of the specific operation button array 5 to thereby output a specific function signal. Besides, reference numeral 19 denotes a signal switching means for sending the specific function signal supplied from the operation button input means 18 to thereby send it exchangeably to either the input data discriminating means 17 or the control console 6, numeral 20 denotes a fault event processing means designed for analytically processing the fault signal on the basis of the fault data available from the display fault detection module 12 or the touch input fault detection module 14 to thereby execute appropriate processing for disposing of the fault by sending the signal indicating the result of the analytical processing to the control console 6 via the signal transmitting means 15 or sending the signal supplied from the specific operation button array 5 by way of the signal switching means 19 directly to the control console 6 or the like processing, and numeral 21 denotes a specific screen image extracting means for extracting a specific screen image in dependence on the contents of the fault as delivered from the fault event processing means 20 to thereby issue an interrupt command to the display drive module 11 for displaying the specific screen image. The means 15 to 21 mentioned above are incorporated in the control/transmission module 10 in the case of the instant embodiment of the invention.

Moreover, reference symbol 11*a* denotes a display means provided in association with the display drive module 11, reference symbol 12*a* denotes a display fault detecting means provided in association with the display fault detection module 12, reference symbol 13*a* denotes a touch switch input means provided in association with the touch input recognition module 13, and reference symbol 14*a* denotes a touch switch fault detecting means provided in association with the touch input fault detection module 14.

Furthermore, the signal cable or line 7 is composed of a first signal line 7*a* electrically connected to the control console by way of the signal transmitting means 15 and a second signal line 7*b* extending from the signal switching means 19 and connected directly to the control console, wherein the first signal line 7*a* and the second signal line 7*b* cooperate to constitute a transmission circuit.

Next, description will be made of the operation of the display/operation apparatus for the elevator system implemented in the structure described above. Ordinarily, the image to be displayed is structured or generated by the display contents structuring means 16 on the basis of the signal supplied from the control console 6, whereon the image as generated is displayed on the image display device 8 by means of the display drive module 11. The passenger or user of the elevator observes the screen image to manipulate the touch switch array 9 located at the position of a virtual operation button array displayed on the image, whereby the touch signal containing the position information generated through the operation mentioned above is converted into the corresponding operation signal by means of the touch input recognition module 13. The input data discriminating means 17 collates the operation signal mentioned above with the image generated by the display contents structuring means 16. More specifically, the input data discriminating means 17 makes decision as to "for what purpose the operation has been performed" on the basis of the virtual button image displayed at the image position indicated by the operation signal, whereon the result of the decision, i.e., the contents of the operation, is signaled to the control console 6 via the signal transmitting means 15. Assuming, by way of example, that the touch switch located at the position 4*c* where the destination indicating button array of the operation panel installed on the elevator car is displayed is manipulated to indicate a fifth floor, then it is decided or recognized that the fifth floor is called as the destination floor, whereupon the car call signal for the fifth floor is transmitted to the control console.

On the other hand, assuming that the specific operation button array 5 is to be made use of, for example, as the door opening button, as will be described later on in FIG. 6, there is then displayed a symbol "door open" on the image display device 8 at a location 4*d* close to the relevant specific operation button. Thus, when the user of the elevator car manipulates the above-mentioned specific operation button, the relevant signal is sent to the input data discriminating means 17 by way of the operation button input means 18 and the signal switching means 19. The input data discriminating means then recognizes that the door opening button has been manipulated and sends the corresponding signal to the control console. In this conjunction, the input data discriminating means may be so designed as to make decision that the door opening button is manipulated when the user touches the symbol area "door open". Independent of the input function adopted in the input data discriminating means 17, the signal indicating the same function may be sent to the control console.

Next, description will be directed to the operation which is carried out when a fault occurs in the touch screen display, i.e., display of the image display device 8, or the touch switch array 9. Incidentally, details of this operation will be elucidated later on in conjunction with a second embodiment of the invention. Accordingly, at this point, description will be made in conjunction with the specific operation button array. When a fault occurring in the display device is detected by means of the display fault detection module 12 or when a fault of the touch panel is detected by the touch panel fault detection module 14, the fault event processing means 20 changes over the signal switching means 19 to recognize the inputs from the specific operation button array 5 inputted through the medium of the operation button input means 18 as the signals prescribed previously for the individual specific operation buttons, respectively, which signal is then sent directly to the control console via the second signal line 7*b*.

Ordinarily, in the display/operation apparatus for the elevator system of the type now under consideration, the screen image, i.e., image to be displayed, is structured in accordance with the command issued from the control console in conformance with the operating state of the elevator at the time point concerned, whereon the input means which is to serve as the operation buttons as required is formed on the touch switch array together with the specific operation button array. By virtue of this feature, there can be realized the display/operation apparatus which ensures a high degree of freedom in displaying operation. In particular, by implementing the specific operation buttons with hardware buttons, it is possible to make available the specific operation button array which can ensure a higher reliability than the touch switch array. Further, by displaying the service information of the specific operation button in the vicinity thereof on the display device, the functions or purposes of the specific operation buttons can be altered or changed without bringing about any appreciable difficulty in recognizing the function or purpose as altered. Thus, the specific operation button array can optimally be made use of as the button array which can ensure the highest reliability for the operation of the elevator system at the concerned time point.

In the foregoing description, it has been presumed that the display/operation apparatus is installed internally of the elevator car as the so-called intra-car operation panel. However, the display/operation apparatus can equally be implemented as the so-called oriented operation panel which is installed at the elevator hall, substantially to the similar advantageous effects.

Embodiment 2

Figure 5:
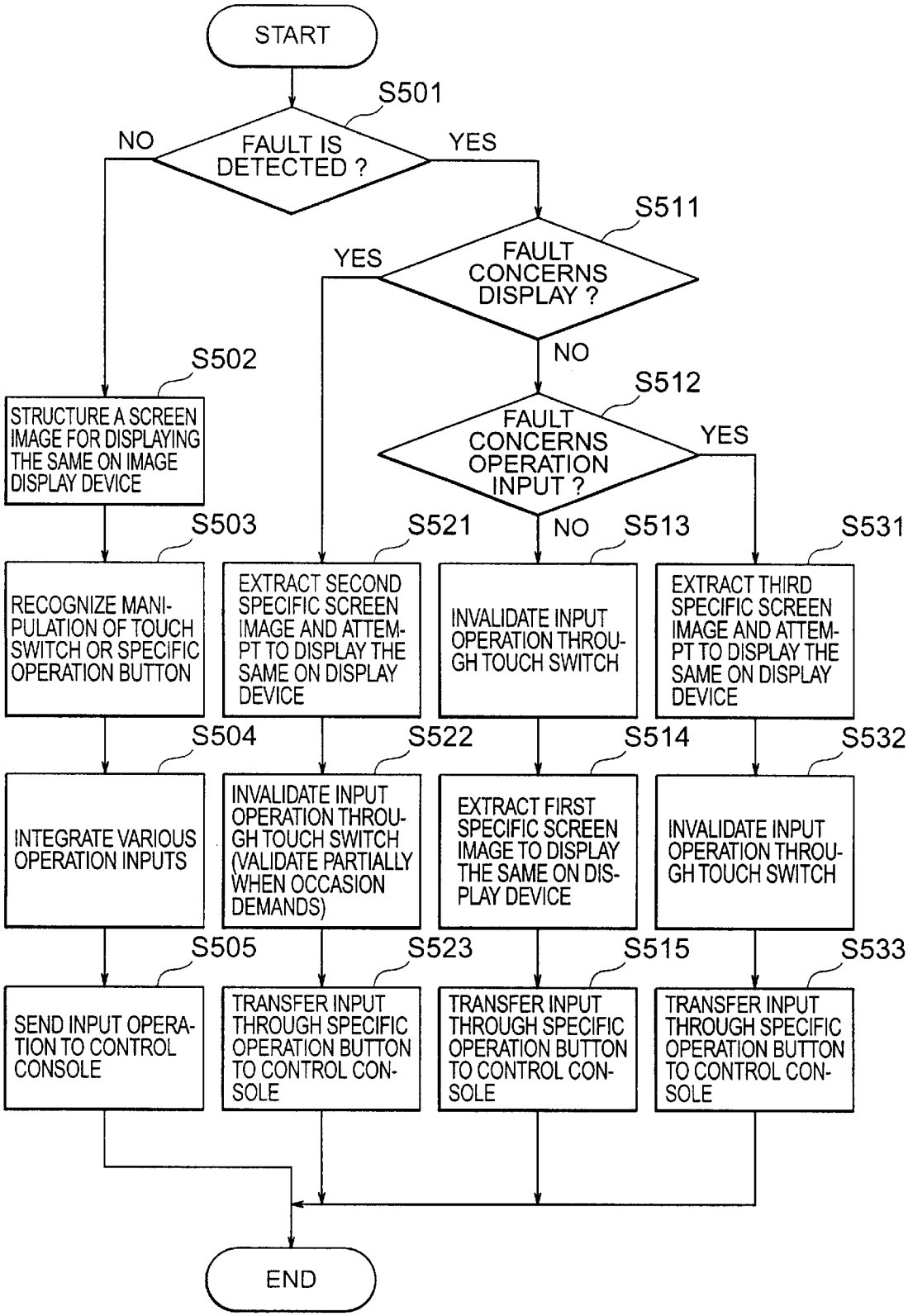
FIG. 5 is a flow chart for illustrating operation of the display/operation apparatus according to the present invention.

Now, description will turn to operation of the display/operation apparatus for coping with a fault. FIG. 5 is a flow chart for illustrating operation of the display/operation apparatus inclusive of the processing executed upon occurrence of a fault. In the description which follows, in addition to this figure, reference is made to FIG. 5 together with FIG. 1 to FIG. 4 referred to in the preceding description of the first embodiment.

Referring to FIG. 5, it is decided in a step S501 whether or not a fault is detected by the fault event processing means 20. When a fault is detected, the processing proceeds to a step S511, whereas when no fault is detected with normality being recognized, the processing proceeds to a step S502. In the step S502, the display contents structuring means 16 is activated for structuring a screen image in accordance with the command issued by the control console 6 to thereby make the screen image be displayed on the image display device 8 through the medium of the display means 11*a*. Subsequently, in a step S503, operation of the touch switch 9 or a button of the specific operation button array 5 is recognized or detected by the touch panel input means 13*a* or the operation button input means 18. In a step S504, decision is made as to whether the operation inputted through the touch panel input means 13*a* or the operation button input means 18 indicates a same function to thereby consolidate or integrate the inputs as a operation input, whereon the operation input is then sent to the control console 6 through the signal transmitting means 15 in a step S505. The flow extending from the step S501 to the step S505 described just above represents the operation of the display/ operation apparatus in a normal operation state.

When occurrence of a fault is detected in the step S501, the processing then proceeds to the step S511 in which decision is made as to whether or not a display fault is detected by means of the display fault detecting means 12*a*. When the display device suffers a fault, the processing proceeds to a step S521. If otherwise, the processing proceeds to a step S512. In the step S512, it is decided whether or not the touch panel fault detecting means 14*a* detects occurrence of a fault in the touch switch input operation (operation input module). When a fault is detected in the touch switch input operation, the processing proceeds to a step S531, whereas, if otherwise, it proceeds to a step S513. In other words, in the case where the fault event processing means recognizes the other fault than that of the display device or the touch switch array, the processing proceeds to the step S513. Subsequently, in the step S513, input operation through the touch switch array 9 is invalidated by deciding that the reliability of the contents displayed on the image display device 8 or that of the contents inputted from the touch switch 9 is lowered due to occurrence of some abnormality in the operation panel 3. In a step S514, a first specific screen image corresponding to this sort of the abnormality or fault taking place is extracted through the medium of the specific screen image extracting means 21 in response to the command issued by the fault event processing means 20. The first specific screen image is then displayed on the display device. In a step S515, only the input through the specific operation button array 5 is transferred to the control console 6. The flow or routine extending from the step S511 to the step S515 indicates the operation of the display/operation apparatus in an abnormal operation state in which no fault is detected for the display device or the touch switch array. In this state, the occurrence of a fault or guide information for the user is displayed or the functions of the manipulatable specific operation buttons are displayed in an area located in the vicinity thereof. In this conjunction, it should be mentioned that there may arise such situation in which the first specific screen image mentioned above can not be displayed although it depends on the status or type of the fault. However, the attempt to display the first specific screen image as described above will provide sufficient convenience to the user.

Upon detection of a fault of the display device in the step S511, the processing proceeds to the step S521 where a second specific screen image corresponding to the fault of the display device is extracted as an attempt to display the same notwithstanding the situation that the fault of the display device has been detected. In succession, in a step S522, the input operation through the touch switch array is rendered invalid because of high probability of occurrence of a fault in the display screen. In this conjunction, it should however be added that inputting through the touch switch may be left valid instead of being invalidated only in a range or area which corresponds to a predetermined virtual input button or buttons making appearance in the second specific screen image. In a step S523, the signal inputted in response to operation of the button of the specific operation button array 5 is transmitted to the control console 6. The flow or routine extending from the step S511 to the step S523 inclusive indicates the operation performed when a fault of the display device is detected. In this case, the possibility of generating the display is low because of the fault of the display screen, displaying of the second specific screen image should be attempted for providing convenience for the user at the very least.

Upon detection of a fault of the touch switch array in the step S512, the processing proceeds to a step S531 where a third specific screen image corresponding to the fault of the touch switch array is extracted for generation thereof. In succession, in a step S532, the inputting operation through the touch switch array is rendered invalid because of little reliability of the very touch signal inputted through the touch switch and because of high probability that the recognition by the touch input recognition module is erroneous. In a step S533, the signal inputted in response to operation of a button of specific operation button array 5 is transmitted to the control console 6. The flow or routine extending from the step S512 to the step S533 inclusive indicates the operation performed when a fault of the touch switch is detected. In this case, by informing not only the fault of the touch switch array to the user in terms of the third specific screen image but also the method of manipulating the specific operation button array as the alternative manipulating means, it is attempted to protect that the user against falling in trouble at the least.

Embodiment 3

Figure 6A:
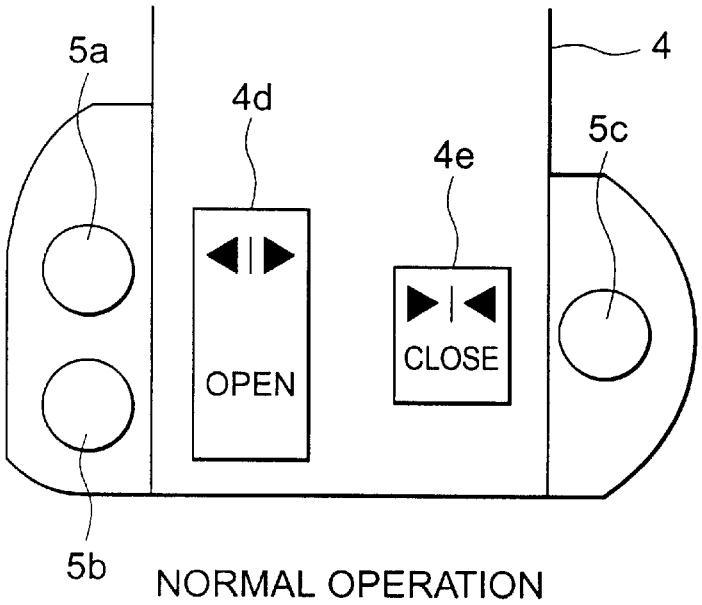
FIGS. 6A and 6B are views showing a portion of an operation panel according to the present invention, in which a normal display state is shown in FIG. 6A, while shown in FIG. 6B is a display state in which a fault is taking place in a touch screen display.
Figure 6B:
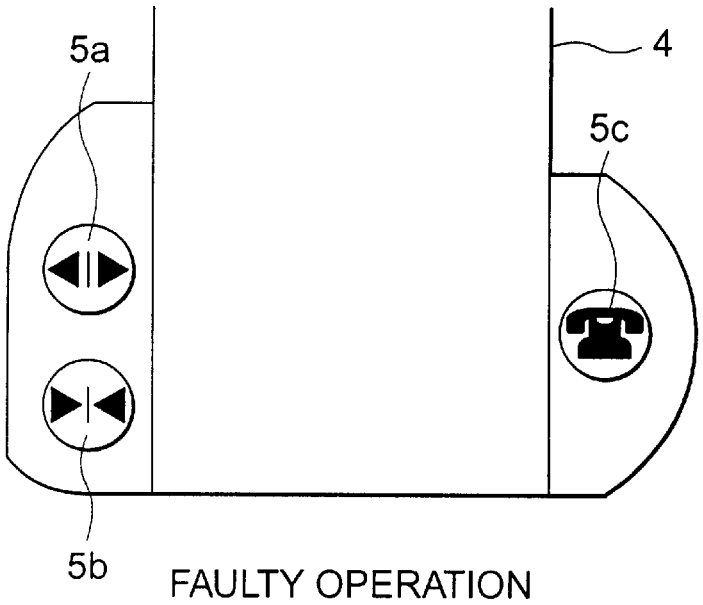
Figure 7:
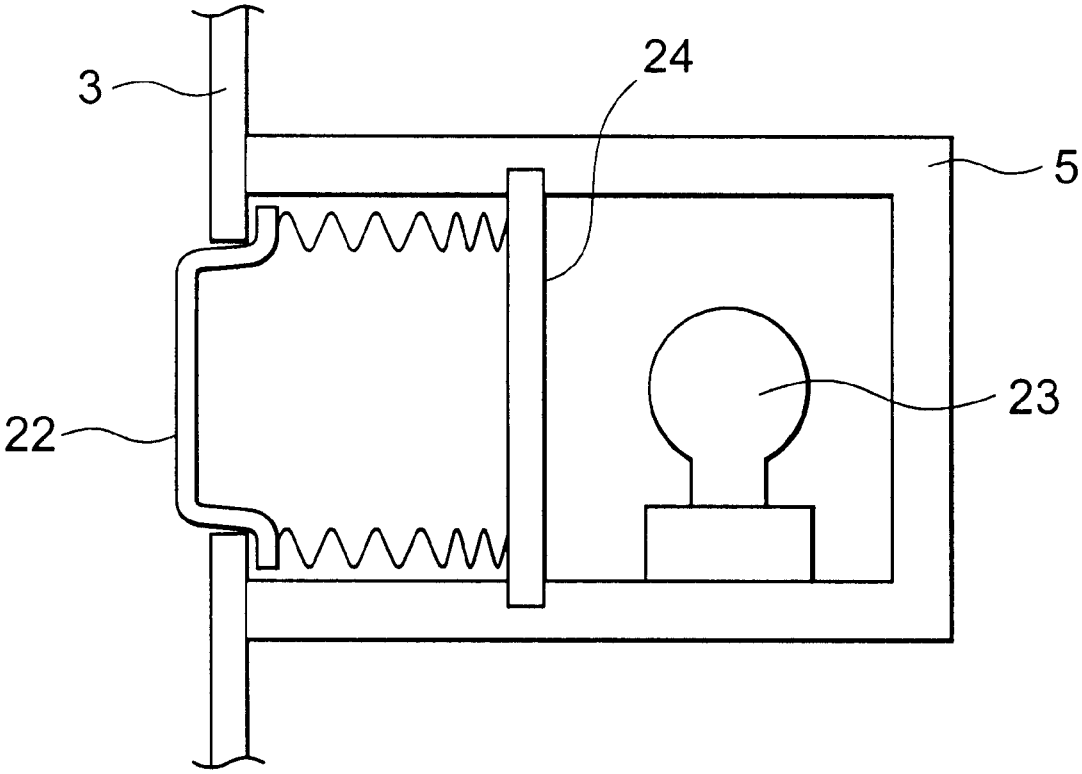
FIG. 7 is a sectional view of a specific operation button according to the present invention.
Figure 8:
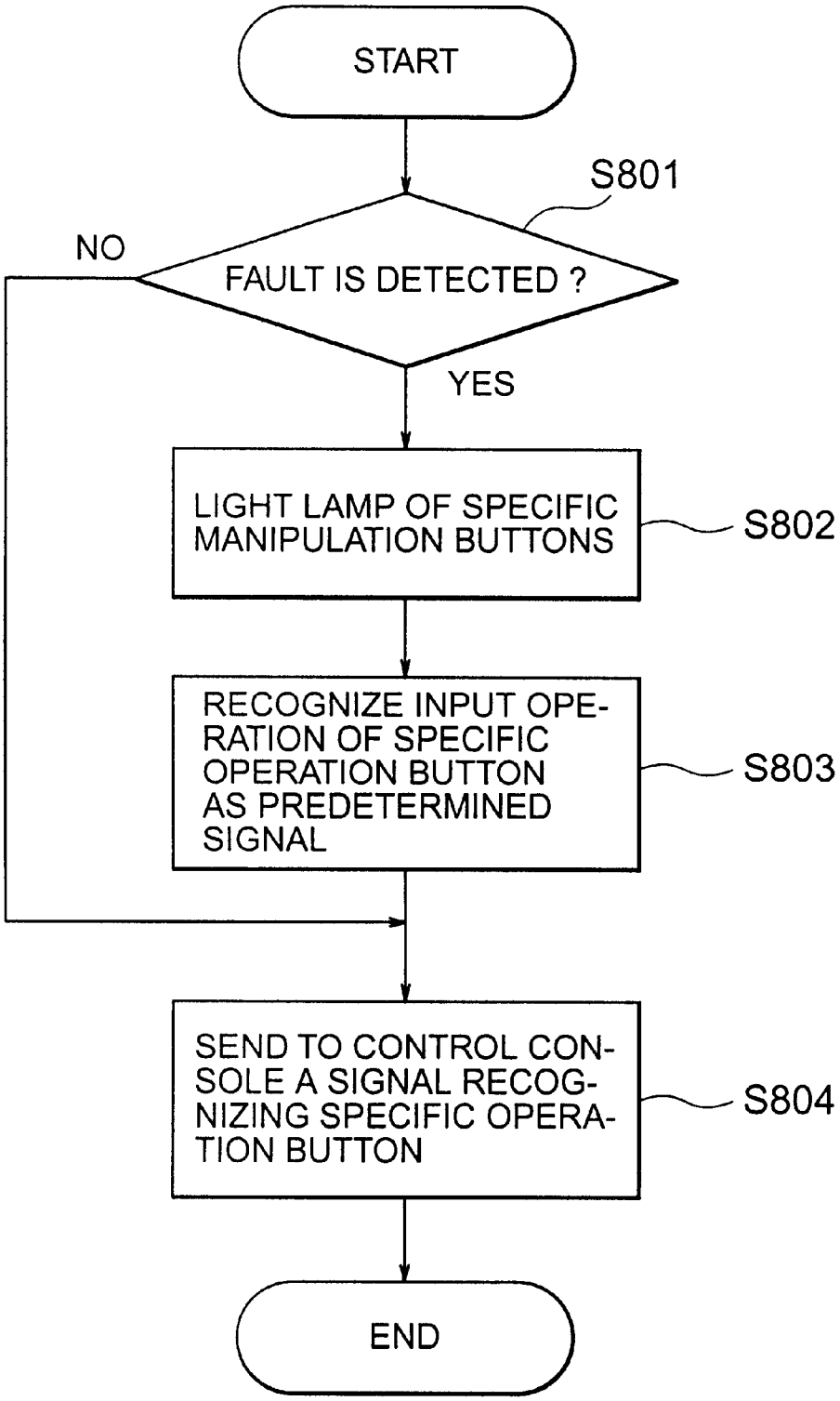
FIG. 8 is a flow chart for illustrating a procedure for displaying a function of the specific operation button provided according to the present invention.

Next, description will be made of an embodiment of the invention which is directed to the specific operation button array of enhanced manipulating performance. FIGS. 6A and 6B are views showing a portion of the operation panel 3 including the specific operation button array 5, in which a display state in the normal operation is shown in FIG. 6A, while shown in FIG. 6B is a display state in which specific functions corresponding to signals prescribed in advance for the specific operation buttons are displayed in response to occurrence of a fault in the display/operation apparatus. Further, FIG. 7 is a sectional view of a specific operation button according to the instant embodiment of the invention, and FIG. 8 is a flow chart illustrating a processing flow for generating a display of the specific operation button array.

Same components as those shown in FIGS. 1 to 4 are denoted by like reference symbols. Reference numeral 22 denotes a push button operation cover designed for recognizing the operation of the specific operation button by the user who pushes the specific operation button with his or her finger, numeral 23 denotes a lamp mounted internally of the specific operation button 5, numeral 24 denotes a picture or image film disposed between the push button operation cover 22 and the lamp 23 in the specific operation button 5.

Operation of the specific operation button array will be described by reference to the flow chart shown in FIG. 8. At first, in a step S801, it is decided whether or not a fault is detected by the fault event processing means 20 described previously in conjunction with the preceding embodiments. When it is decided that the fault is detected, then the processing proceeds to a step S802. On the other hand, when no fault is detected with normality being decided, then the processing proceeds to a step S804. Since it is assumed that occurrence of a fault in the display/operation apparatus is recognized, a command for lighting the lamps 23 of the specific operation button array 5 is issued. When the lamps 23 are lit in response to the reception of the command, light rays emitted from each lamp transmits through the image film 24 to impinge on the push button operation cover 22. As a result of this, when the user observe the push button operation cover 22, he or she can see the image printed on the image film 24 and projected onto the push button operation cover 22. Thus, the user can know the button function of the specific operation button array 5 from the image on the push button operation cover 22. Subsequently, when the button of the specific operation button array 5 is manipulated, the predetermined signal relevant to the manipulated button of the specific operation button array 5 is recognized in a step S803, as described hereinbefore in conjunction with the preceding embodiments. The inputted signal is sent to the control console 6 through the medium of the signal switching means 19 in a step S804.

Thus, the display on the operation panel 3 according to the instant embodiment of the invention is such as illustrated at (A) in FIG. 6 in the normal operation state, wherein a pair of specific operation buttons 5*a* and 5*b* disposed at the left-hand side of the touch screen display 4 function as "door opening buttons", while the specific operation button 5*c* disposed at the left-hand side functions as "door closing button". On the other hand, upon occurrence of a fault in the display/operation apparatus, the lamps 23 of the individual buttons of the specific operation button array 5 are lit, as illustrated at (B) in FIG. 8. More specifically, the upper specific operation button 5*a* disposed at the left side of the touch screen display 4 serves as "door opening button", while the lower specific operation button 5*b* serves as "door closing button". On the other hand, the specific operation button 5*c* disposed at the left hand side of the display 4 serves as a call button for an interphone communicating to a manager's office or the like of the elevator system.

An example of operation and operations of the elevator will be described below. In the normal operation state, the user manipulates the virtual operation buttons as displayed, which is detected by means of the touch switches and signalled to the control console, whereby the elevator car is operated correspondingly. However, when a fault takes place in the touch screen display, there may arise such unwanted situation that the touch screen display disappears or detection of the touch switch is rendered impossible. Accordingly, in that case, operation of the elevator car will primarily have to rely on the operation of the specific operation button array. In this conjunction, let's assume as an example of elevator car operation that the display/operation apparatus is installed as the intra-car operation panel and that the elevator car is stopped in response to a hall call with the door being opened for allowing the passenger to get on the car, the button "door closing button" of the specific operation button array is manipulated to cause the elevator car to travel to the succeeding floor where the door is opened. By repeating this operation, the passenger or user can reach the destination floor. In this conjunction, when it becomes necessary to open the car door for allowing a third person to get on the car, this can be realized by manipulating "door opening button" of the specific operation button array.

Further, in the case where the user feels that he or she is confined within the car, then the user may manipulate the specific operation button labeled "door opening" for opening the door to extricate him- or herself from the confinement. Further, upon occurrence of the fault such as mentioned above, the passenger will want to establish contact with the manager of the elevator system without delay. To this end, the passenger may manipulate the button labeled "interphone call" in the specific operation button array. Then, connection with the manager can speedily be established.

With the display/operation apparatus arranged such that the functions of the specific operation buttons can be displayed as occasion demands, as described above, the passenger can newly recognize the functions of the specific operation buttons even in the case where the functions of these specific operation buttons have been changed due to occurrence of a fault in the touch screen display. Thus, the passenger can remain at ease.

In the foregoing description, it has been presumed that the three specific operation buttons are provided and that the functions "door open", "door close" and "interphone call" are imparted to these specific operation buttons, respectively. However, the present invention is never restricted to such arrangement.

As the display device, there may be employed various types of devices such as CRT, liquid crystal display, PDP, EL display and dot LED, etc. Similarly, as the touch panel, various panels such as resistant film-type panel, optical-type panel, electrostatic-capacity-type panel system and ultrasonic-type panel, etc. can be made use of.

Furthermore, the present invention is never restricted to the fault detecting method and the detection of the fault described above in conjunction with the embodiments. Other detection schemes may be adopted. Besides, other sorts of faults may be coped with. Additionally, the present invention is not restricted to the signal transmission described above in conjunction with the illustrated embodiments. In other words, various versions and modifications are possible within the spirit and scope of the present invention.

INDUSTRIAL APPLICABILITY

With the structure of the display/operation apparatus for the elevator system such as, for example, the intra-car operation panel or the hall-oriented operation panel which includes the image display device and the touch screen display in which the touch switches are disposed in overlap with a displayed image of the image display device, wherein the specific operation button array is provided which allows predetermined input operation to be performed upon occurrence of a fault at least in the touch screen display, the elevator system can be prevented from shutting down even when a fault takes place in the touch screen display.

Further, by virtue of such arrangement that an image representing a selected function of the specific operation button is displayed on the image display device in the vicinity or the specific operation button itself is displayed as occasion requires, the function of the specific operation button can easily be recognized by the user.

Furthermore, owing to such arrangement that the operation control module is provided which is so arranged as to display the image structured or generated by the display drive module in accordance with a command issued from the elevator control console, recognize the operation signal on the basis of the operation position signal inputted through the touch switch and the image displayed on the image display device while recognizing the input from the specific operation button array mentioned above as the specific function signal to thereby send out the operation signal and the specific function signal to the elevator control console as one and the same signal when the operation signal and the specific function signal mentioned above are decided as representing one and the same function, it is possible to reduce the transmission load while mitigating the burden imposed onto the control console disposed at the receiver side.

Besides, with the arrangement that the operation signal and the specific function signal are sent out to the elevator control console by way of the different transmission circuits, respectively, and that when the operation signal and the specific function signal represent one and the same function, the operation signal and the specific function signal are recognized as one and the same signal by the elevator control console upon reception thereof, a fault which may occur in the transmission module used ordinarily in the display/operation apparatus can also be coped with, whereby the reliability of the display/operation apparatus can be enhanced correspondingly.

Furthermore, because the specific image is attempted to be positively displayed even when a fault is taking place, service can be provided for the users for ensuring tranquillity to a possible minimum.

Besides, by invalidating in principle the operation with the touch switch upon occurrence of a fault, input operation based on the unreliable display due to the fault or recognition of the unreliable touch input operation can be avoided with high reliability. Such advantageous effect can be enjoyed owing to the provision of the specific operation button array among others.

What is claimed is:

1. A display/operation apparatus for an elevator system, comprising an image display device and a touch screen display in which touch switches overlap with a displayed image of said image display device, wherein a specific operation button array is provided for input operation upon occurrence of a fault in said touch screen display.

2. The display/operation apparatus for an elevator system set forth in claim 1, wherein an image representing a selected function of a specific operation button of the specific operation button array is displayed on said image display device proximate the specific operation button.

3. The display/operation apparatus for an elevator system set forth in claim 1, wherein said display/operation apparatus is installed in an elevator car or at an elevator hall.

4. The display/operation apparatus for an elevator system set forth in claim 1, wherein the specific operation button array lights lamps displaying functions of relevant specific operation buttons of the specific operation button array, respectively, upon occurrence of a fault in said touch screen display.

5. The display/operation apparatus for an elevator system set forth in claim 1, comprising a display drive module for commanding an image to be displayed on said image display device, a touch switch array for outputting a signal containing information concerning a position of a touch switch manipulated, a touch input recognition module for recognizing an input signal for a touch switch in accordance with an image displayed on said image display device, based on the input signal containing the information of the position detected by said touch switch array, and an operation control module displaying the image generated by said display drive module on said image display device in response to a command issued from an elevator control console, recognizing an operation signal based on an operation position signal inputted through said touch switch array and the image displayed on said image display device while recognizing the input from the specific operation button array as a specific function signal to send the operation signal and the specific function signal to said elevator control console.

6. The display/operation apparatus for an elevator system set forth in claim 5, when the operation signal and the specific function signal are detected as representing the same function, said operation control module recognizes the operation signal and the specific function signal as one and the same signal.

7. The display/operation apparatus for an elevator system set forth in claim 5, wherein the operation signal and the specific function signal are sent to the elevator control console by way of different transmission circuits, respectively, and when the operation signal and the specific function signal represent one and the same function, the operation signal and the specific function signal are recognized as one and the same signal by said elevator control console upon reception of the specific function signal and the operation signal.

8. The display/operation apparatus for an elevator system set forth in claim 5, wherein said operation control module includes fault control means for issuing a command indicating that a specific screen image be displayed on said image display device upon detection of occurrence of a fault in an image display by said image display device or by said touch input through the touch switch.

9. The display/operation apparatus for an elevator system set forth in claim 5, wherein said operation control module sends out the signal inputted through a specific operation button of the specific operation button array as a specific function signal upon detection of occurrence of a fault in an image display by said image display device or by said touch input through the touch switch array.

10. The display/operation apparatus for an elevator system set forth in claim 1, wherein upon occurrence of a fault in image display by said image display device or said touch input through the touch switch, an image for coping with the fault is displayed on a specific operation button of the specific operation button array or in an area located close to the specific operation button.

11. The display/operation apparatus for an elevator system set forth in claim 1, wherein upon detection of a fault in either of said image display device or said display drive module, input operation through said touch switch array is invalidated, and a signal generated in response to operation of a specific operation button of the specific operation button array is sent to an elevator control console.

12. The display/operation apparatus for an elevator system set forth in claim 1, wherein upon detection of a fault in either of said image display device or a display drive module, a command is issued so said image display device displays a specific screen image while invalidating input operation through the touch switch array, and an operation signal of a specific operation button of the specific operation button array is sent to an elevator control console upon operation of the specific operation button.

13. The display/operation apparatus for an elevator system set forth in claim 1, wherein upon detection of a fault in either of said image display device or said display drive module, a command is issued so said image display device displays a specific screen image while allowing input operation through said touch switch array to be partially validated in correspondence with the specific screen image, and in response to operation of said touch switch left validated or operation of a specific operation button of the specific operation button array, an input signal of said touch switch or an operation signal of the specific operation button is sent to an elevator control console.

14. The display/operation apparatus for an elevator system set forth in claim 1, wherein, upon detection of a fault in either of said touch switch or a touch input recognition module, a command is issued so said image display device displays a specific screen image while invalidating input operation through said touch switch array, and an operation signal of a specific operation button of the specific operation button array is sent to an elevator control console upon operation of the specific operation button.

* * * * *